US009080419B2

(12) United States Patent
Benson et al.

(10) Patent No.: US 9,080,419 B2
(45) Date of Patent: Jul. 14, 2015

(54) BENTONITE COLLARS FOR WELLBORE CASINGS

(76) Inventors: Craig H. Benson, Verona, WI (US); Ivan Kornienko, Almaty (KZ); Nygmet Ibadildin, Almaty (KZ)

( * ) Notice: Subject to any disclaimer, the term of this patent is extended or adjusted under 35 U.S.C. 154(b) by 322 days.

(21) Appl. No.: 13/542,390

(22) Filed: Jul. 5, 2012

(65) Prior Publication Data

US 2014/0008068 A1 Jan. 9, 2014

(51) Int. Cl.
*E21B 33/12* (2006.01)
*E21B 33/14* (2006.01)

(52) U.S. Cl.
CPC ..... *E21B 33/14* (2013.01); *E21B 33/1208* (2013.01)

(58) Field of Classification Search
CPC ..... E21B 17/1042; E21B 17/1078
See application file for complete search history.

(56) References Cited

U.S. PATENT DOCUMENTS

| | | | | |
|---|---|---|---|---|
| 3,705,838 | A * | 12/1972 | Olton et al. | 428/454 |
| 7,070,001 | B2 | 7/2006 | Whanger et al. | |
| 2004/0261990 | A1 | 12/2004 | Bosma et al. | |
| 2005/0199401 | A1* | 9/2005 | Patel et al. | 166/387 |
| 2007/0056735 | A1* | 3/2007 | Bosma et al. | 166/295 |
| 2008/0210422 | A1* | 9/2008 | Clark et al. | 166/254.2 |
| 2009/0038800 | A1 | 2/2009 | Ravi et al. | |
| 2009/0200043 | A1* | 8/2009 | Olinger | 166/387 |
| 2009/0205816 | A1 | 8/2009 | De et al. | |
| 2009/0205818 | A1* | 8/2009 | Klunge et al. | 166/179 |
| 2009/0205841 | A1* | 8/2009 | Kluge et al. | 166/387 |
| 2009/0229816 | A1* | 9/2009 | Lemme et al. | 166/179 |
| 2010/0218949 | A1 | 9/2010 | Badalamenti et al. | |
| 2010/0252254 | A1* | 10/2010 | Nutley et al. | 166/192 |
| 2012/0006533 | A1* | 1/2012 | Barnard et al. | 166/241.1 |

FOREIGN PATENT DOCUMENTS

| | | | |
|---|---|---|---|
| GB | 2411918 | A | 9/2005 |
| JP | 9013866 | A | 1/1997 |
| WO | WO 2006/045794 | A1 | 5/2006 |

OTHER PUBLICATIONS

International Search Report and Written Opinion issued in PCT/US2013/049188, Oct. 11, 2013.

* cited by examiner

*Primary Examiner* — Angela M DiTrani
(74) *Attorney, Agent, or Firm* — Bell & Manning, LLC

(57) ABSTRACT

Casing assemblies and methods of using the casing assemblies to isolate selected sections of a subterranean wellbore are provided. Also provided are methods of fabricating the casing assemblies. The casing assemblies comprise one or more water-swellable tubular collars disposed around the exterior surface of a conduit, such as a wellbore casing. The water-swellable collars are formed from a material comprising sodium bentonite, a swelling inhibitor and reinforcing fibers.

22 Claims, 7 Drawing Sheets

BENTONITE COLLARS FOR WELLBORE CASINGS

BACKGROUND

Traditional isolation of well casings in well production is accomplished with the use of concrete slurries and/or bentonite chips, which are inserted between the well casing and the wellbore after the casing has been inserted into the bore. Unfortunately, neither of these methods guarantees reliable isolation of the casing because wellbores having extreme depths are not perfectly straight. Even minor deviations from a straight wall in a wellbore create difficulties when a casing is installed into the well because the casing will come into contact with the wall surface inside the wellbore at one or more points of deviation. Thus, when a concrete slurry or bentonite chips are poured into the annular space between the wall of the wellbore and the casing, they can become clogged at the points where the casing meets the bore wall, resulting in incomplete and non-uniform isolation of the casing.

SUMMARY

Casing assemblies and methods of using the casing assemblies to isolate selected sections of a subterranean wellbore are provided.

The casing assemblies comprise: (a) a conduit having an interior surface that defines a tubular channel and an exterior surface; and (b) a water-swellable tubular collar having an interior surface that is disposed around the exterior surface of the conduit and an exterior surface. The tubular collars are formed from a material comprising sodium bentonite, a swelling inhibitor and a plurality of fibers dispersed in the sodium bentonite, the material having a water content of no greater than about 10 wt. %. For some embodiments of the water-swellable tubular collars, the material from which the collar is made is formulated such that it swells to 100% of its initial volume within a time period in the range from about 15 hours to about 20 hours.

The exterior surface of the water-swellable tubular collars may define a plurality of extensions extending radially, outwardly. For example, such extensions may define a plurality of longitudinal channels disposed around the circumference of the tubular collar, the channels running substantially parallel with the longitudinal axis of the conduit.

The casing assemblies may, optionally, also include a remote position sensing device comprising a signal transmitter and a signal receiver, wherein the signal transmitter is associated with the water-swellable tubular collar.

Methods for sealing an annulus between a wellbore casing and the wall of a wellbore using the present casing assemblies comprise the steps of: (a) inserting a wellbore casing having at least one water-swellable tubular collar disposed around its exterior surface into the wellbore; and (b) exposing the water-swellable tubular collar to an aqueous environment, whereby the water-swellable tubular collar swells to an extent sufficient to seal the annulus between the wellbore casing and the wall of the wellbore.

Other principal features and advantages of the invention will become apparent to those skilled in the art upon review of the following drawings, the detailed description, and the appended claims.

BRIEF DESCRIPTION OF THE DRAWINGS

Illustrative embodiments of the invention will hereafter be described with reference to the accompanying drawings, wherein like numerals denote like elements.

DETAILED DESCRIPTION

Casing assemblies and methods of using the casing assemblies to isolate selected sections of a subterranean wellbore are provided. Also provided are methods of fabricating the casing assemblies. The casing assemblies can provide more uniform and reliable isolation of a casing in a wellbore than concrete slurries or clay chips. In addition, the casing assemblies have a simple design, which allows for relatively fast and simple installation.

Figure 1:
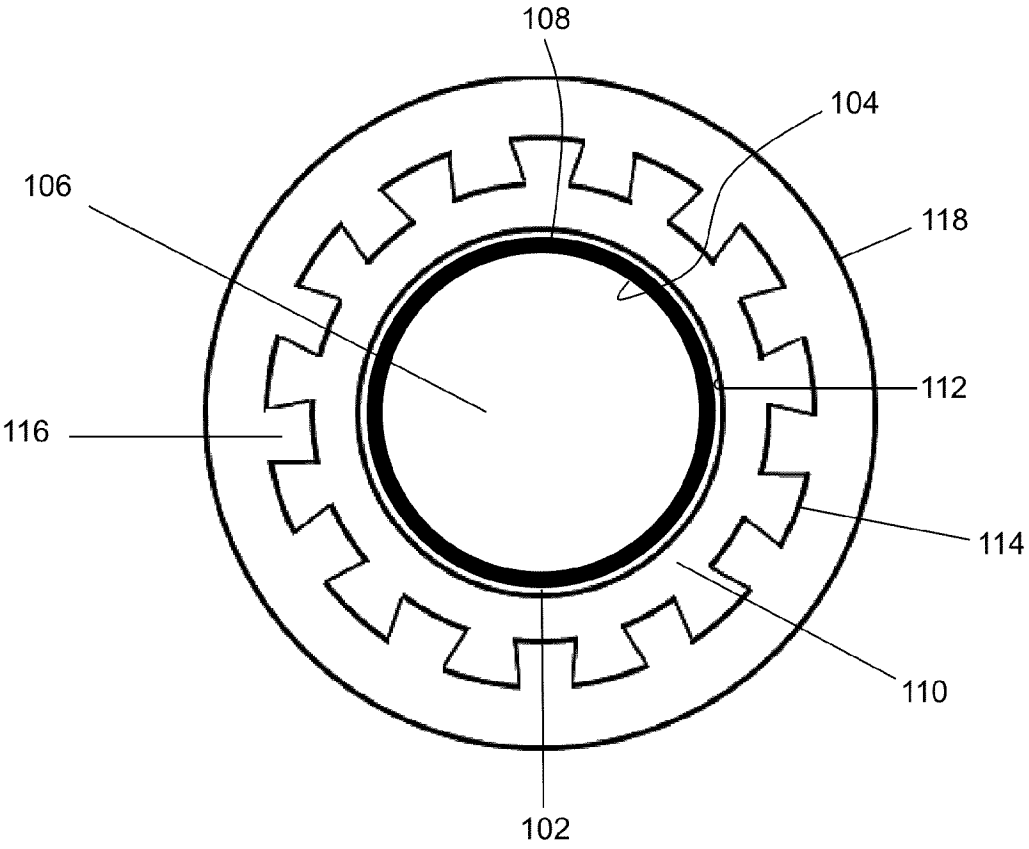
FIG. 1 is a schematic diagram showing a cross-sectional view of a collar assembly in a subterranean wellbore.

The casing assemblies comprise one or more water-swellable tubular collars disposed around the exterior surface of a conduit, such as a wellbore casing. A schematic diagram of a cross-sectional view of a casing assembly is shown in FIG. 1. As shown in this figure, the conduit 102 has an interior surface 104 that defines a tubular channel 106 and an exterior surface 108. The tubular collar 110 has an interior surface 112, which is disposed around exterior surface 108 of conduit 102, and an exterior surface 114. (In the figure, the gap between the interior surface of the tubular collar and the exterior surface of the conduit is exaggerated so that all of the surfaces are visible.) The assembly is inserted in a wellbore 118.

The conduit may be any conduit configured for use in providing structural support to a subterranean wellbore, protecting and facilitating the passage of drilling and/or production equipment in a wellbore, isolating different geological formations in a wellbore and/or transporting fluids in a wellbore. In some embodiments of the assemblies, the conduit is a wellbore casing. The conduit can be made of a variety of materials, including but not limited to, metals, metal alloys, ceramics and polymers.

At least one water-swellable tubular collar comprising sodium bentonite is disposed around the conduit at a position chosen to provide isolation of one or more sections of the earth formation into which the wellbore is drilled. Multiple water-swellable collars (e.g., at least two, at least three, at least four, at least five, or more) can be placed around the conduit to isolate multiple sections of the wellbore. As illustrated in FIG. 1, the interior surface 112 of the collar is sized to allow it to fit snuggly over the exterior surface of the conduit. The exterior surface 114 of collar can be textured in order to provide a high surface area through which water can be absorbed in order to facilitate the water-induced swelling of the collar. For example, the exterior surface can be textured with a plurality of radial extensions extending outwardly in a direction that is substantially perpendicular to the longitudinal axis running through the tubular collar. In the embodiment shown in FIG. 1, the extensions run along the length of the collar and form a plurality of longitudinal channels 116 disposed around the circumference of the tubular collar and running substantially parallel with the longitudinal axis of the collar. This design is advantageous because, in addition to increasing the exterior surface area of the collar, the channels provide furrows along which aqueous fluids and water can pass. The length of each collar can be tailored based on the limitations of the collar fabrication equipment and the nature of the geological formations to be isolated. By way of illustration only, in some embodiments, the water-swellable collars have a length in the range from about 20 cm to about 60 cm. The separation between the water-swellable collars may vary over a wide range. By way of illustration only, in some embodiments, the separation between the water-swellable collars is in the range from about 20 to about 100 cm.

The water-swellable collars are formed from a material comprising sodium bentonite and a swelling inhibitor. In addition to the sodium bentonite, other forms of bentonite, such as calcium bentonite, may be present. A plurality of reinforcing fibers are dispersed in the sodium bentonite. The water content of the water-swellable collars, prior to their exposure to any aqueous environment in a wellbore, is desirably no greater than about 14 wt. %.

The sodium bentonite used in the fabrication of the water-swellable collars desirably has a minimum swelling capacity of at least 24 ml/2 g, as measured by its swell index in accordance with the standard test method ASTM D5890. The moisture content of the sodium bentonite used in the fabrication of the water-swellable collars is desirably no greater than about 12 wt. % (e.g., no greater than about 10 wt. %). In some embodiments, the sodium bentonite-content of the collar material is in the range from about 65 to about 95 wt. %. This includes embodiments of the collars in which sodium bentonite accounts for about 70 to about 90 wt. % of the collar material.

At least one swelling inhibitor is included in the collar material in order to reduce the rate of water-induced swelling of the sodium bentonite relative to the rate of water-induced swelling in the absence of inhibitor. The amount of swelling inhibitor in the collar material is desirably chosen to provide a water-swellable collar material that will undergo swelling on a timescale practical for wellbore sealing applications. Thus, in some embodiments sufficient swelling inhibitor is added to provide a material characterized in that it swells to 100% of its initial volume within a time period in the range from about 15 hours to about 20 hours after being immersed in water. This includes materials formulated such that they swell to 100% of their initial volume within a time period from about 17 to about 19 hours after being immersed in water. (As used herein, the initial volume of the collar can be taken as the volume of the collar just prior to the insertion of the collar assembly into the wellbore.) By way of illustration, in some embodiments, the swelling inhibitor content of the collar material is in the range from about 0.1 to about 5 wt. %. This includes embodiments of the collars in which swelling inhibitor accounts for about 0.5 to about 2 wt. %. Carbomethyl cellulose is an example of a suitable swelling inhibitor. Other suitable swelling inhibitors include inorganic phosphates, polyanionic cellulose and methacrylates. The use of swelling inhibitors in the collar material formulation is advantageous because it eliminates the need for expandable bladders, such as polymeric sheets, disposed over the surface of the collar and designed to prevent contact with aqueous fluids until the bladder is breached.

Fibers can be added to the water-swellable collar materials in order to provide structural reinforcement so that the collar maintains its form without cracking during extrusion and drying and to minimize or prevent deformation of the collar as it is placed in a wellbore. Fibers having an average length in the range from about 20 mm to about 50 mm are well-suited for this purpose. By way of illustration, in some embodiments, the fiber content of the collar material is in the range from about 0.1 to about 5 wt. %. This includes embodiments of the collars in which fibers account for about 0.5 to about 2 wt. % of the collar material. The fibers can comprise organic polymers. Polypropylene is an example of a suitable fiber material. Other suitable fiber materials include fiberglass, polymeric resins, polyesters and polyamides.

The remainder of the water-swellable collar material may be water. Thus, in certain embodiments, the collars are formed from a material that consists of, or consists essentially of, sodium benonite or a mixture of sodium bentonite and calcium bentonite, swelling inhibitor, dispersed fibers, water and, optionally, surfactant and/or wetting agent and/or plasticizer.

Table 1 provides some example formulations for bentonite-based materials that may be used to fabricate the water-swellable collars. These formulations represent the material that is feed into the extruder. Unless otherwise specified, amounts given in percentages represent weight percent based on the weight of the bentonite components.

TABLE 1

Bentonite-Based Clay Formulations

| | Formulation | | | | | |
|---|---|---|---|---|---|---|
| Component | 1 | 2 | 3 | 4 | 5 | 6 |
| Sodium Bentonite, mesh 200, moisture content 12 wt. % | 100% | 100% | 100% | 100% | 100% | 100% |
| Calcium Bentonite, mesh 200 | n/a | | 25% | 25% | | |
| Swell Inhibitor: carbomethylcellulose (Industrial purity) | 1.6% | 1.6% | 2.8% | 3% | 1.6% | 1.6% |
| Water | 20% | 15% | 20% | 15% | 20% | 20% |
| $Na_2CO_3$ | | | 3% | 3% | | |
| Fibers: polypropylene | 1.2% | | | | | 1% |
| Fibers: resin | | 1.2% | | 1.2% | | 0.5% |
| Fibers: polyester | | | 1.2% | | | |
| Polyanionic acid | | 1.2% | 1.2% | 1.2% | 1.2% | |

The water-swellable collar assemblies may further comprise an adhesive material disposed between the exterior surface of the conduit and the interior surface of the collar in order to prevent the collar from sliding along the length of the conduit as it is inserted into the wellbore, or as it expands in place. For example the adhesive material may take the form of a layer of adhesive coating disposed between, and in direct contact with, the exterior surface of the conduit and the interior surface of the collar. The adhesive material can be applied to the exterior surface of the conduit before the water-swellable collar is placed around the conduit. Alternatively, a plurality of holes can be formed through the wall of the water-swellable collar during collar fabrication. The adhesive material can then be introduced through these holes after the collar is in place around the conduit. The latter approach can provide a tighter and more homogenous bond between the exterior surface of the conduit and the interior surface of the collar. Polyurethane foam is one example of a suitable adhesive material. However, other adhesives may be employed.

A metal band, such as an iron band, can be placed around the collar assembly and the position of the metal band can be monitored remotely during installation in order to ensure that the collar assembly in placed in the desired location within the wellbore. The collar assembly may, optionally, further comprise one or more remote position sensing devices that allow the position of the one or more water-swellable collars to be monitored as the assembly is inserted into a wellbore and/or once the assembly is in place in the wellbore. The remote positioning sensing device can also be used to confirm the integrity of the collar assembly after it has been inserted into the wellbore because a signal will only be emitted if the electrical communication to the device has not been interrupted. Thus, a lack of signal can indicate whether the collar has been significantly damaged or destroyed. The remote position sensing device comprises two components: a signal transmitter and a signal receiver. Geophysical monitoring systems can be used for this purpose. The signal transmitter is associated with the one or more water-swellable tubular collars and is configured to emit a signal, such as an electromagnetic signal, capable of being detected by the signal receiver. The signal receiver can be located at, and operated from, the surface of the earth formation in which the wellbore in formed. Examples of signal transmitters and receivers are radiowave transmitters and receivers. As used herein, the term "associated with a water-swellable tubular collar" refers to a device that has a known (i.e., known to the user) spatial location with respect to the water-swellable tubular collar. For example, the signal transmitter can be affixed (directly or indirectly) to the collar or can be affixed (directly or indirectly) to the conduit either immediately adjacent (above or below) the collar or at a set, known distance (above or below) the collar.

Figure 6:
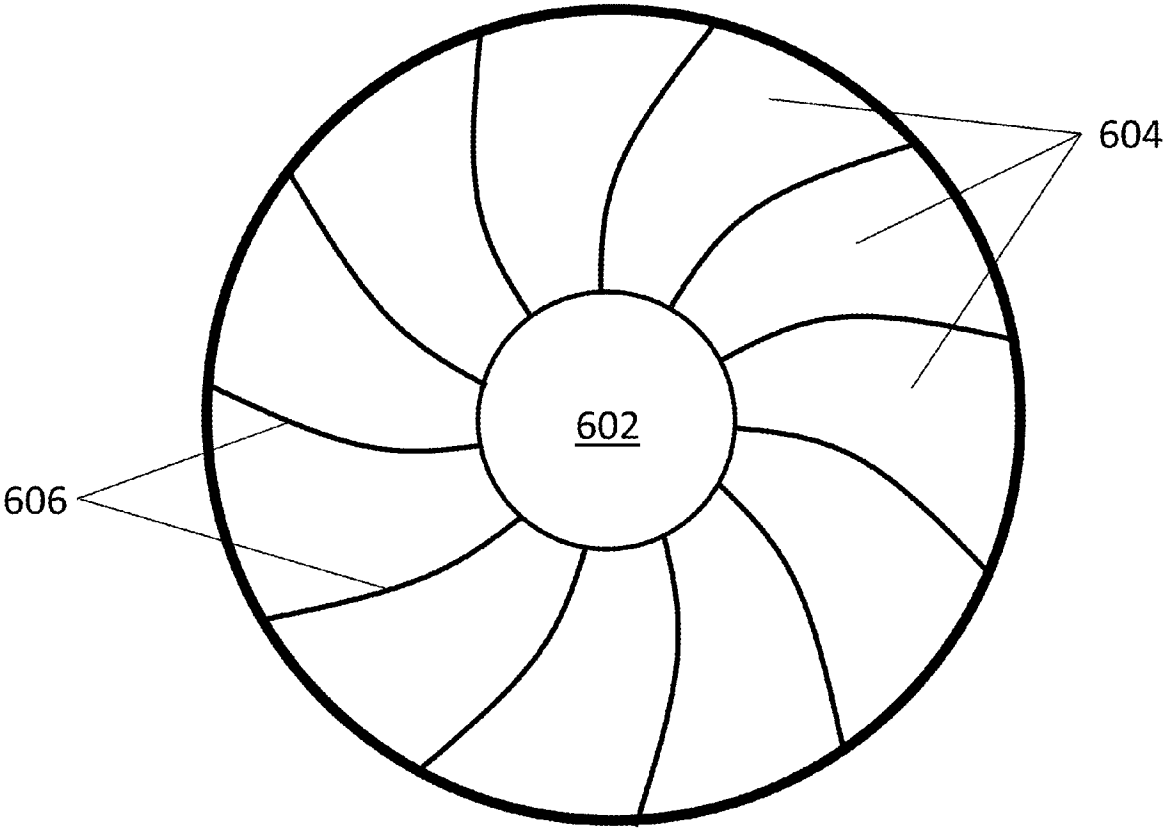
FIG. 6 is a schematic diagram of a top view of a collar stop for a water-swellable collar.

The collar assembly may further comprise an upper collar stop positioned adjacent to and/or around the upper end of the collar and configured to prevent the collar from sliding along the length of the conduit as the casing assembly is inserted into a wellbore or as the collar swells. Similarly, the collar assembly may further comprise a lower collar stop positioned adjacent to and/or around the lower end of the collar and configured to prevent the collar from sliding along the length of the conduit as the casing assembly is inserted into a wellbore or as the collar swells. The construction of the collar stops can be quite simple. For example, in some embodiments, the collar stops may comprise bands (e.g., a metal bands) disposed around the conduit immediately above and below the collar. In other embodiments, the collar stops can have a more complex design. FIG. 6 shows a collar stop having a substantially circular perimeter. The collar stop defines a central opening 602 having a plurality of extensions 604 extending radially outwardly therefrom. In this embodiment, the lateral edges of the extensions 606 define two-dimensional curves, such that when central opening 602 is disposed around a conduit and the extensions are bent upward over a water-swellable collar, the edges of neighboring extensions overlap to seal the space beneath the end of the collar and the conduit. Alternatively, the collar stop can include extensions having straight lateral edges. However, if straight-edged extensions are used, it is advantageous to use two or more nested collar stops, wherein the extensions of the nested collar stops are rotationally offset, in order to sufficiently seal the space beneath the end of the collar and the conduit.

Methods of using the water-swellable tubular collars in wellbore sealing applications are also provided. The methods include the steps of inserting a wellbore casing having at least one water-swellable tubular collar disposed around its exterior surface into the wellbore; and subsequently exposing the water-swellable tubular collar to an aqueous environment, whereby the water-swellable tubular collar swells to an extent sufficient to seal the annulus between the wellbore casing and the wall of the wellbore. As described in detail, above, the water-swellable tubular collar has an interior surface that is disposed around the exterior surface of the wellbore casing and an exterior surface, and is formed from a material comprising sodium bentonite, a swelling inhibitor and a plurality of fibers dispersed in the sodium bentonite, the material having a water content of no greater than about 10 wt. % prior to swelling in the wellbore.

Figure 2A:
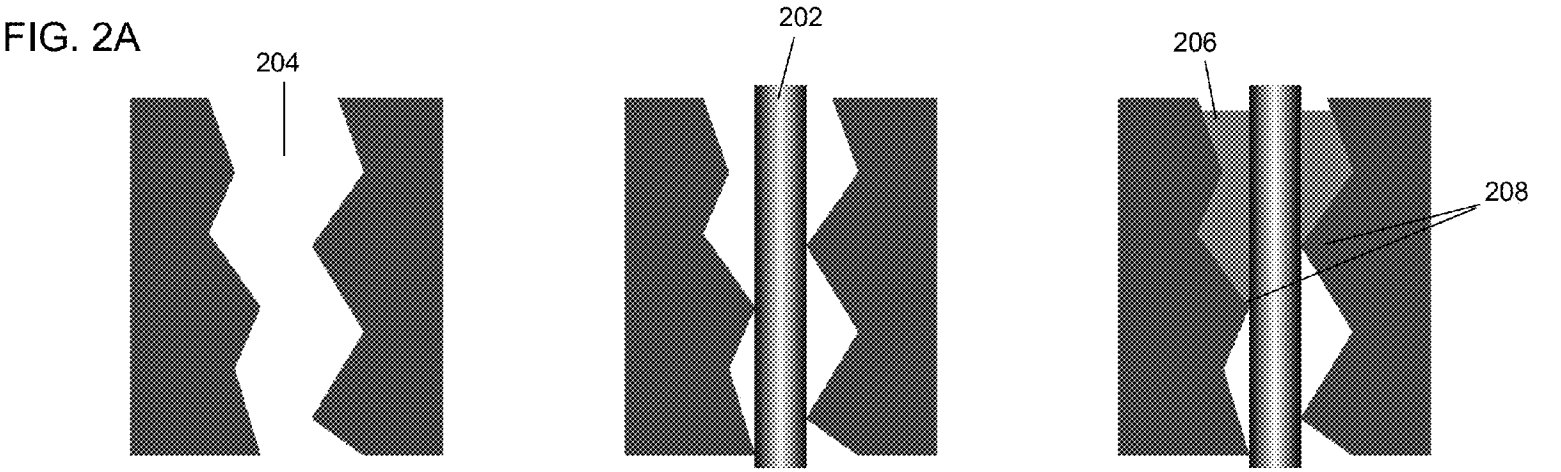
FIG. 2A is a schematic diagram showing a conventional method of isolating a casing in a wellbore.
Figure 2B:
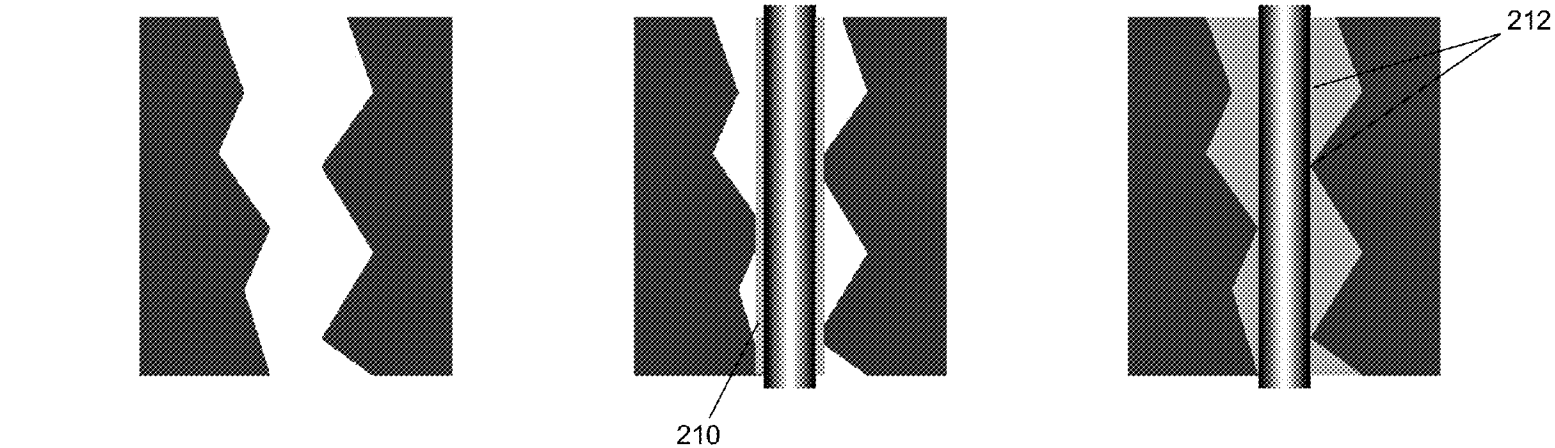
FIG. 2B is a schematic diagram showing a method of isolating a casing in a wellbore using the present casing assemblies.

FIG. 2(A) provides a schematic illustration of conventional means for sealing the annular space between the casing in a subterranean wellbore and the wall of the earth formation that defines the wellbore. As shown in the three upper panels of FIG. 2(A), conventional methods for sealing the annulus include the steps of inserting a tubular casing 202 into a wellbore 204 and, subsequently, introducing a sealing material 206, such as concrete slurry or clay chips, into the wellbore. Unfortunately, because the wall surface along the depth of the wellbore is not perfectly cylindrical, the casing comes into contact with the wellbore wall at certain points 208. As shown in the third panel of FIG. 2(A), the result is that the sealing material can become clogged at the points of contact. In contrast, as shown in the three lower panels of FIG. 2(B), the present methods utilize a water-swellable bentonite-based collar 210 which expands upon exposure to water to fill the annulus. As shown in the final panel of FIG. 2(B), swollen material 212 can span the entire gap between the exterior surface of the casing and the wall of the wellbore along at least a portion of the wellbore depth.

Using the present methods, different areas of the geological formation into which a wellbore is drilled can be isolated from one another to prevent fluids contained in one area (e.g., in one stratum) from reaching another area (e.g., another stratum). Examples of wellbores into which the collar assemblies can be inserted include wellbores for the production of hydrocarbons, such as oil wellbores, wellbores for the leaching of minerals in a subterranean geological formation and wellbores for geothermal energy production. Thus, by way of illustration only, in an oilfield application the present methods can be used to isolate a groundwater-containing area of a geological formation from hydrocarbon-containing area of the geological formation. Or, in a mineral leaching application, the present methods can be used to isolate a groundwater-containing area of a geological formation from a mineral-containing area of the geological formation and the conduit can be configured to deliver a leachant solution (e.g., an acid solution) to one or more of the mineral-containing areas of the geological formation and/or to deliver a solution comprising dissolved minerals back to the surface of the formation.

The exposure of the water-swellable collar to water can be accomplished by placing the water-swellable collar at a position along the casing where it will come into contact with a naturally occurring source of water contained within a geological formation. Alternatively, the source of water can be created as a by-product of a production process. For example, the water used to cause the swelling of the collar may come from a drilling fluid, a treating fluid or a production fluid. When the water is not from a naturally occurring source, it can be delivered to the water-swellable collar by, for example, introducing it directly into the annulus between the casing and the wellbore or by introducing it into the casing and allowing it to pass into the annulus between the casing the wellbore via one or more apertures in the casing wall.

The thickness of the water-swellable collar, measured from the interior surface of the collar to the outermost exterior surface of the collar can be tailored based on the relative diameters of the casing and the wellbore. For example, some embodiments of the collars have a thickness of at least ⅓ the thickness of the annulus between the exterior surface of the casing and the interior surface of the wellbore wall. This includes embodiments having a thickness of at least ½ the thickness of the annulus between the exterior surface of the casing and the interior surface of the wellbore wall.

The methods of making the present casing assemblies can be separated into four phases: 1) preparing the bentonite-based collar material; 2) extruding the collar; 3) drying/dehydrating the extruded collar; and 4) grinding out the interior diameter of the collar to fit the exterior diameter of the conduit. The Example below provides a detailed description of an illustrative method that includes each of these phases. A more general description of each of the phases is provided immediately below.

Preparation of the Water-Swellable Collar Material.

The material from which the collars are made can be produced by mixing sodium bentonite in a granular form with water and, optionally, a wetting agent to form an aqueous bentonite solution in which the bentonite undergoes hydration. To this solution, a swelling inhibitor and reinforcing fibers are added, either sequentially or consecutively. Polymer fibers can be added as formed fibers, or can be formed in situ by mixing a fiber-precursor chemical to the solution and polymerizing the precursor molecules in solution to form the fibers. Table 2 illustrates the steps that can be used to prepare the bentonite material, including the ingredients added at each step, the amounts of each that ingredient added based on a weight pro rata basis, and the approximate time duration of each step. (This table is meant to illustrate certain embodiments of the method. It is not intended to limit any disclosed inventions to the specific parameters included in the table.)

TABLE 2

Production of Collar Material.

| Step | Start with granular bentonite | Add water (and wetting agent) | Add swelling inhibitor | Add fibers |
|---|---|---|---|---|
| Amount of Ingredient, based on weight | 100% | 20-25% (2-8%) | 0.5-5% | 0.5-5% |
| Duration | ≤10 min. | ≤20 min. | ≤10 min. | ≤10 min. |

Extrusion of the Collar.

The resulting material mass, or 'pug', can now be extruded into the form of a collar. An extrusion process and apparatus are described in the Example below.

Drying/Dehydrating the Collar.

Once the material has been extruded into the form of a collar, the collar can be dried to reduce its water content. Generally, the extruded collar is dried until the water content of the collar is no greater than about 14 wt. %. The drying process can be carried out in one or more stages, with the drying temperature being reduced at each stage. Drying should be carried out at a temperature below the vitrification temperature of the material since vitrified bentonite has a very low capacity for water-induced swelling.

Grinding the Interior Bore.

Once the collar has been dried, the interior bore can be ground out to achieve a straight and uniform interior diameter that is appropriate for the casing with which it is to be used. In addition, the surface of the interior bore may be roughened to enhance the friction between the collar and the casing to reduce unintended slippage of the collar along the casing.

EXAMPLE

This example illustrates certain embodiments of the methods of making water-swellable tubular collars and certain embodiments of using the water-swellable tubular collars in an oilfield production well.

Fabrication of Bentonite Collar:

The production of the water-swellable bentonite-based collar can be divided into four phases: preparation of the collar material; extrusion of the 'green' collar; drying (dehydrating) the collar; and grinding the interior surface of the collar.

Preparation of the Materials.

High quality sodium bentonite having a granular size of mesh 200 or 74 microns was used in the present example. The initial moisture content of the benonite was about 10 wt. %. An aqueous solution of the sodium bentonite was prepared by mixing the sodium bentonite with enough water and sodium carbonate to provide a solution having a weight ratio of water to bentonite of about 0.225 and a weight ratio of sodium carbonate to benonite of about 0.05. The sodium carbonate was used as a wetting agent for the bentonite clay in order to facilitate clay hydration. The hydration process was desirably carried out with continuous mixing for a period of about 10 minutes at a temperature of at least 30° C.

Once the bentonite was hydrated, carbomethyl cellulose (industrial purity) was added as a swelling inhibitor. The amount of carbomethyl cellulose was sufficient to provide a composition having a weight ratio of carbomethyl cellulose to benonite of about 0.5 to 2%. In addition to acting as a swelling inhibitor, the carbomethyl cellulose can act as a dispergation agent for the clay particles, which facilitates extrusion of the material and enhances the performance of the material in the field.

Mixing was continued for an additional ten minutes, then polypropylene was added in granular form to provide a composition having a weight ratio of polypropylene to benonite of about 1%. During the subsequent mixing of the resulting blend, the polypropylene granules were converted into polypropylene fibers, which help to prevent the material from cracking as it dried. This blend was mixed for another ten minutes to provide a pug ready for placing it into the extruder.

Extrusion of the Pug.

In this example, a special die was used for the extrusion of the pug. Initially, the die formed the green pug of the bentonite collar, which was then cut to the desired length by a knife. The die was polished for smooth processing of the green pug. This process was carried out under vacuum in order to achieve better adhesion of the clay particles in the material. In addition, a copper wire was installed around the collar as a remote position sensing device at this stage—before the material was dried.

The die was designed to provide an extruded collar without a longitudinal seam having a cross-sectional profile as shown in FIG. 1. Conventionally extruded ceramic pipes have longitudinal seams running along their side wall as a result of the fixing of the die inside the extruder. For most ceramic pipe applications, this seam does not affect the quality or performance of the pipe because the extruded pipe is subsequently fired at a high temperature, such that the pipe's overall resistance to compressive stress is sufficient. However, conventional extrusion processes are not well-suited for the production of at least some embodiments of the present water-swellable collars. This is because the collars can have thicker walls and more complicated exterior surface textures than typical ceramic pipes. For example, the bentonite collars may be sufficiently thick that a longitudinal seam would break upon drying due to the weight of the material and the high rate of bentonite settling, which results because it hydrates so well initially. Therefore, the presence of a seam increases the risk that the collar will break or crack under compressive stress.

In this example, seamless construction is made possible by a rotating rod that is inserted into the extruded pug, but is not connected to the body of the die or extruder. The rotating rod is located outside of the extruder and is centered along the central longitudinal axis of the moving extruded pug of bentonite. The rotation of the rod was in the opposite direction of the rotation of the auger.

Figure 4A:
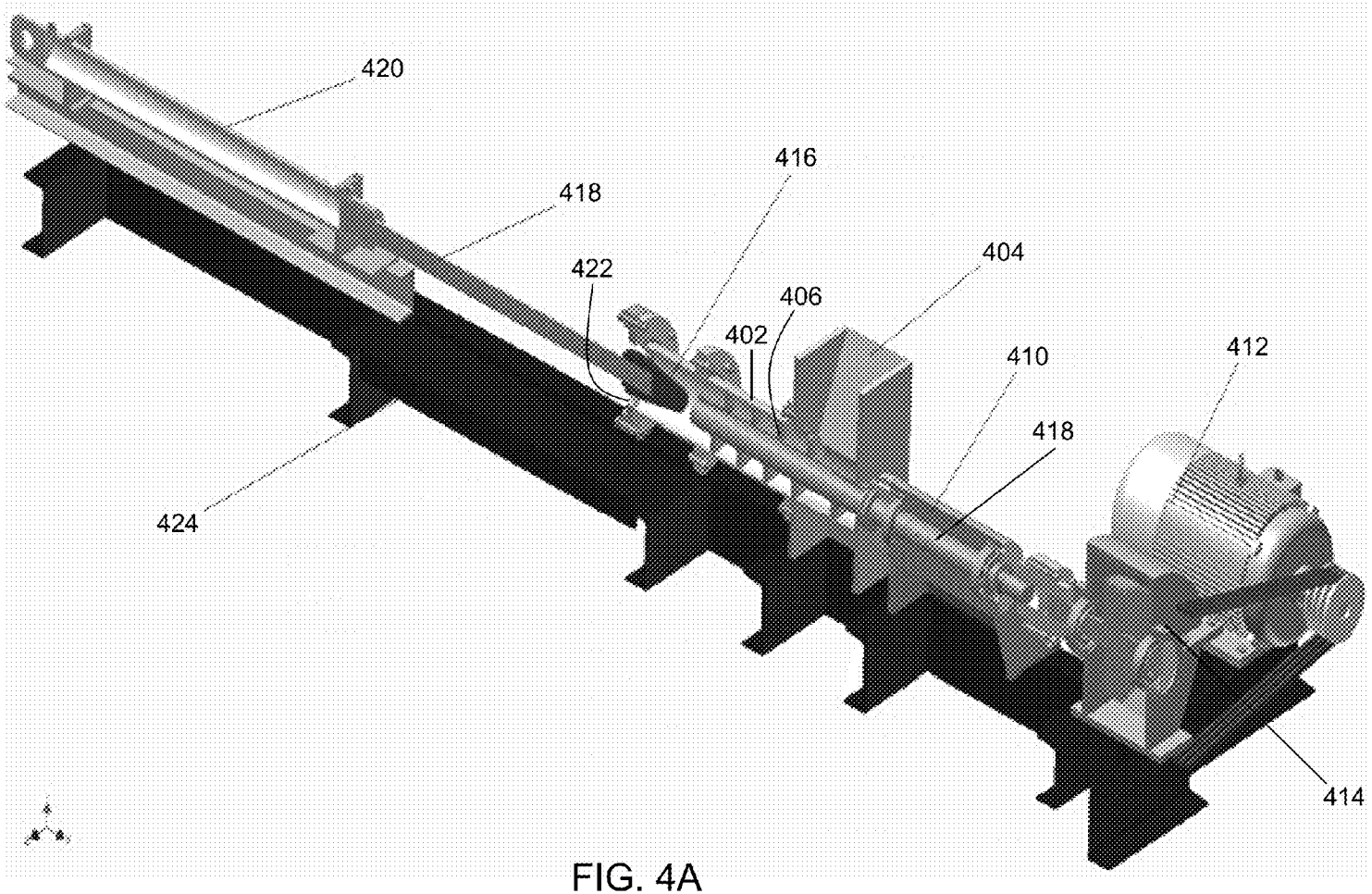
FIG. 4A is a schematic diagram showing a perspective view of an extrusion apparatus that can be used to fabricate a water-swellable collar.
Figure 4B:
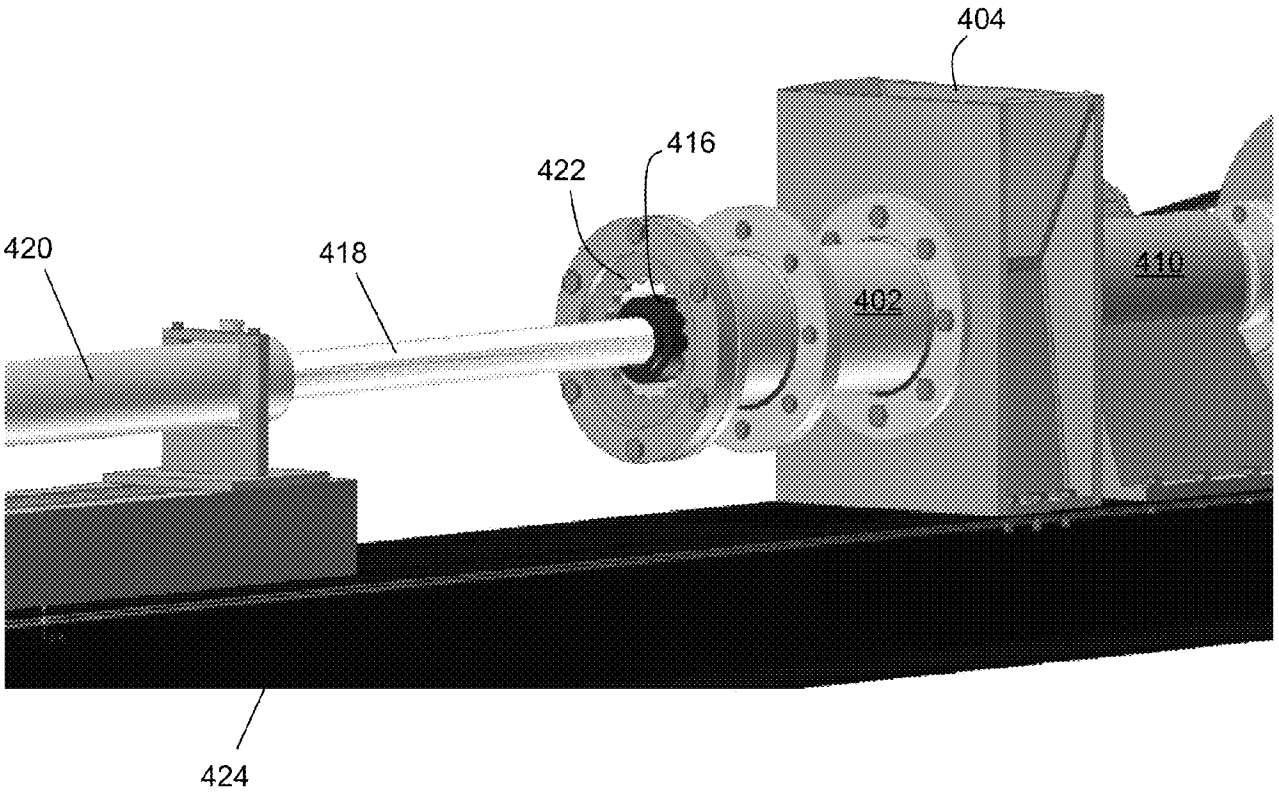
FIG. 4B is a schematic diagram showing an enlarged view of the exit of the extrusion chamber.

FIGS. 4(A) and (B) show perspective views of the extrusion apparatus used to fabricate the water-swellable collar. The apparatus includes extrusion chamber 402 into which a bentonite-based clay material can be introduced through an input port 404. Extrusion chamber 402 houses an auger 406 configured to move the bentonite-based clay material through the extrusion chamber. Auger 406 is connected to an auger spindle 408 housed within a spindle chamber 410. The rotation of spindle 408 is controlled by a motor 412 through a gear assembly housed within a gear box 414. A centering peak 416 configured to form the interior surface of the collar extends into, and is centered within, extrusion chamber 402. As shown here, centering stock is tapered toward its proximal end. Centering peak 416 is mounted to the movable stock 418 of a hydrolic cylinder 420, such that it can be inserted into and retracted from extrusion chamber 402. This design makes it possible to fabricate the collars without a longitudinal seam. As the material exits extrusion chamber 402, passes between centering peak 416 and a production matrix (exit portal) 422 that defines the shape of the exterior surface of the collar. FIG. 4(B) is enlarged view of the exit of extrusion chamber 402, showing the relative positions of centering peak 416 and production matrix 422. As shown in this figure production matrix 422 is designed to define a plurality of radial extensions into the exterior surface of a collar, running along it length. The entire apparatus can be mounted to a frame 424.

The wall thickness of the water-swellable bentonite collar (at the time it was applied to the casing) was tailored based on the outer diameter of the casing and the standard inner diameter of the bore into which the casing and collar were to be inserted, such that the water-swellable collar would seal the annulus between the casing and the wellbore in a desired timeframe. In this embodiment, the collar was designed with a wall thick enough to fill the annular space between the casing and the surface of the wellbore in a hydration process lasting approximately 18 hours. However, the bentonite collar was still sufficiently thin that it could be inserted into a wellbore without being impeded or blocked by protrusions along the wall of the wellbore that result from the deviation of the wellbore from a perfectly cylindrical shape. With the above considerations in mind, the thickness of bentonite collar, measured as the distance between its interior and outermost exterior surfaces, was designed to be half (50%) of the thickness of the annulus between the outer diameter of the casing and the standard inner diameter of the wellbore. More specifically, the inner diameter of the bentonite collar was 91 mm, the outer diameter of the casing was 90 mm, the outermost exterior diameter of the bentonite collar was in the range from about 125 to about 130 mm (with some variation introduced during the drying process) and the standard inner diameter of the wellbore was 160 mm. Thus, the wall thickness of the bentonite collar was 20-25 mm. In this example, the 'outermost exterior surface' of the collar is taken to be the outermost surfaces of the radial longitudinal extensions disposed around the circumference of the collar. In the embodiment of this example, the longitudinal channels defined between these extensions had a depth of about 8 mm.

Drying the Extruded Collar.

The extruded material was dried at a temperature of up to about 80° C. This temperature provided smooth drying and avoided deformation of the collar. Drying was carried out in a two-stage process in a drying chamber with hot air circulation. In the first stage, drying was carried out at 30° C. for five hours. In the second stage, drying was carried out at a temperature of 80° C. for an additional five hours. The water content of the collar after drying was less than 12 wt. %. The final, dried collar was tested in full scale right after drying.

Grinding/Polishing the Interior Bore.

The final phase, before packaging and shipment, was fixing the interior diameter of the collar to correct for any curvature or shrinkage that developed during the drying process. This was accomplished by polishing the interior surface of the collar so that it would fit over the casing. Polishing was accomplished using a face mill of the appropriate diameter with an electric drive. It is desirable for the interior diameter of the collar to be at least about 0.5 mm greater than the exterior diameter of the casing to provide for unimpeded passing of the collar onto the casing.

Testing and Characterization of the Collar:

Once prepared, the water-swellable tubular collars can be characterized by their swelling indices, fluid loss, permeability and resistance to vertical pressure (compressive strength).

Bentonite Swell Index.

Standard test methods in accordance with API 13 A or ASTM D 5890 were used to measure the swell index of the raw bentonite and the collar material. In the case of the collar material, 2 grams of the collar were taken right after the drying phase. These pieces were cut and ground to a mesh size of 200. The standard tests were performed on these ground samples. A swell index value of 35 ml/2 g was measured for the collar material.

Figure 5:
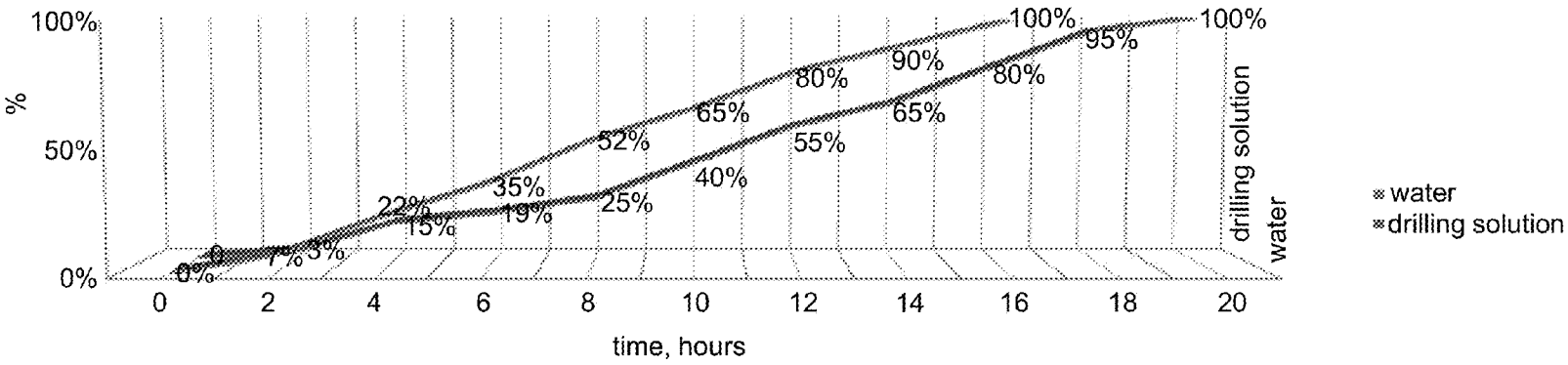
FIG. 5 is a graph of the percent swelling as a function of time for a sodium bentonite collar material. (The upper, shorter curve represents swelling in water. The lower, longer curve represents swelling in a simulated drilling mud solution.)

Using these tests, it was determined that the collar material swelled to 100% of its original volume in a period of 16 to about 20 hours when the slurry was prepared in either water or an aqueous mud solution designed to imitate a typical drilling mud. The results of the swelling tests are presented in FIG. 5.

Fluid Loss.

Standard test methods in accordance with ASTM D 5891 or API 13 A and API 13 B were used to measure the fluid loss of the collar material. A fluid loss value of no greater than 18 ml was measured.

Permeation Test.

Permeation testing was conducted using a flexible wall permeameter in accordance with a testing procedure similar to ASTM 5887. This test measures hydraulic conductivity and the ability of the material to make a hydraulic barrier in a well. Samples for the test were taken from the finished collar material. The material was ground to a mesh size of 200. The weight of the resulting powder tested was 40 g. A non-woven geotextile was used instead of metal plates in the flexible wall permeameter. The collar material was placed in the permeameter, the permeameter was sealed and the test was conducted in a manner similar to that described by ASTM 5887. The measured hydraulic conductivity of the specimen was better than $1\times10^{-8}$.

Compressive Strength.

The compressive strength of the collar was tested using a universal testing machine. The collar had a compressive strength of greater than 3.5 $N/mm^2$.

Field Application:

Once prepared, the bentonite collars should be stored and transported in a water-free or substantially water-free environment. During packing, storage, transport and unpacking, care should be taken to avoid damaging the surface of the collars or compromising their structural integrity.

Assembly.

The collars can be placed around the casing on site. The collars are desirably adhered directly to the exterior surface of the casing using a coating of adhesive material. In this example, a polyurethane foam was applied to the exterior surface of the casing and the collar slid over the casing and the layer of foam. As the polyurethane foam expanded, it filled the void between the collar and the casing. The purpose of the adhesive is to ensure that the collar remains at the desired location along the length of the casing so that it is delivered to the intended location in the wellbore. Any extra adhesive remaining after the collar is adhered to the casing can be removed by the operator.

In another design that was tested, the collar was fabricated with a plurality of holes through which the polyurethane foam was introduced. In this design, six holes were formed through the wall of the collar while it was still green (not dried). The diameters of the holes were 10 mm. A first pair of holes was positioned 10 cm from the upper edge of the collar. The holes in the pair were drilled opposite to each other. Then two subsequent hole pairs, each spaced 10 cm apart were drilled into the collar. This design allowed for a more rapid, cleaner introduction of the foam.

Next a metal band having a radio transmitter mounted thereto was affixed above the water-swellable collar, around the casing. As such, this metal band assembly provided a remote position sensing device, as well as a collar stop, to prevent the water-swellable collar from changing its position along the length of the casing. A second collar stop comprising a band of plastic was affixed around the casing below the water-swellable collar and around the lower end of the water-swellable collar. The lower stop served to ease the insertion of the casing and the collar into a wellbore and to prevent sliding or expansion of the water-swellable collar along the casing as the casing material hydrated.

Remote Position Monitoring.

Figure 3:
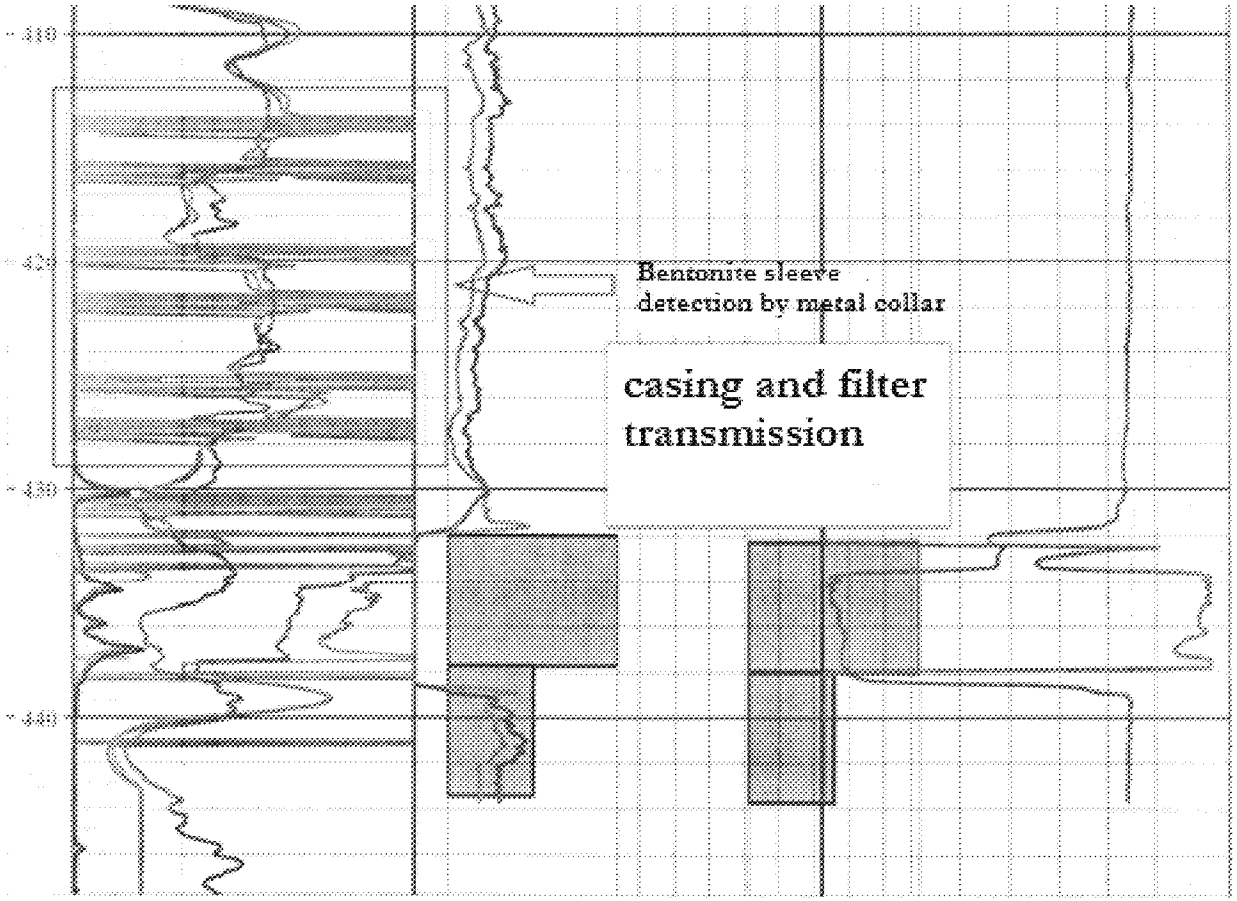
FIG. 3 is a graph showing the remote position monitoring of a water-swellable collar on a casing assembly as it is inserted into a subterranean wellbore.

Detection of the bentonite collar position within a wellbore was carried out using geophysical monitoring equipment. The radio transmitter mounted to the metal band was used to enhance the remotely detected signal. FIG. 3 shows a graph of the signal detected by the geophysical monitor as the collar assembly was inserted into a wellbore, where depth of the wellbore is provided in meters.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, the use of "and" or "or" is intended to include "and/or" unless specifically indicated otherwise.

The foregoing description of illustrative embodiments of the invention has been presented for purposes of illustration and of description. It is not intended to be exhaustive or to limit the invention to the precise form disclosed, and modifications and variations are possible in light of the above teachings or may be acquired from practice of the invention. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. A casing assembly comprising:

(a) a conduit having an interior surface that defines a tubular channel and an exterior surface; and (b) a water-swellable tubular collar having an interior surface that is disposed around the exterior surface of the conduit and an exterior surface, wherein the tubular collar is formed from a material comprising a mixture of sodium bentonite with a swelling inhibitor and a plurality of fibers dispersed in the sodium bentonite, the material having a water content of no greater than about 10 wt. %.

2. The assembly of claim 1, wherein the material comprising the mixture of sodium bentonite, a swelling inhibitor and a plurality of fibers dispersed in the sodium bentonite is characterized in that it swells to 100% of its initial volume upon immersion in water within a time period in the range from about 15 hours to about 20 hours.

3. The assembly of claim 1, wherein the material comprises about 70 to about 90 wt. % sodium bentonite, up to about 5 wt. % swelling inhibitor, and up to about 5 wt. % fiber, based on the total weight of the material.

4. The assembly of claim 1, wherein the exterior surface of the water-swellable tubular collar defines a plurality of radial, longitudinal extensions extending outwardly therefrom, the radial longitudinal extensions running substantially parallel with one another and with the longitudinal axis of the conduit.

5. The assembly of claim 4, wherein the extensions define a plurality of longitudinal channels disposed around the circumference of the tubular collar, the channels running substantially parallel with one another and with the longitudinal axis of the conduit.

6. The assembly of claim 1, further comprising a coating of adhesive material disposed between, and in direct contact with, the exterior surface of the conduit and the interior surface of the water-swellable, tubular collar.

7. The assembly of claim 1, wherein the conduit comprises a casing adapted for use in a subterranean wellbore.

8. The assembly of claim 7, wherein the conduit comprises an oilfield well casing.

9. The assembly of claim 7, wherein the conduit comprises a geothermal well casing.

10. The assembly of claim 7, wherein the conduit comprises a mineral leaching well casing.

11. The assembly of claim 7, further comprising a remote position sensing device comprising a signal transmitter associated with the water-swellable tubular collar.

12. The assembly of claim 1, wherein the conduit comprises a casing adapted for use in a subterranean wellbore; wherein the exterior surface of the water-swellable tubular collar defines a plurality of longitudinal channels disposed around the circumference of the tubular collar, the channels running substantially parallel with one another and with the longitudinal axis of the conduit; and wherein the material comprising the mixture of sodium bentonite, a swelling inhibitor and a plurality of fibers dispersed in the sodium bentonite is characterized in that it swells to 100% of its initial volume upon immersion in water within a time period in the range from about 15 hours to about 20 hours.

13. The assembly of claim 1, wherein the assembly does not include an expandable bladder that is disposed over the exterior surface of the water-swellable tubular collar and that is configured to prevent the collar from contacting an aqueous environment until the bladder is breached.

14. The assembly of claim 1, wherein the swelling inhibitor is selected from the group consisting of carboxy methyl cellulose, inorganic phosphates, polyanionic cellulose and methacrylates.

15. A method for sealing an annulus between a wellbore casing and a wall of a wellbore, the method comprising:

(a) inserting a wellbore casing having at least one water-swellable tubular collar disposed around its exterior surface into the wellbore, wherein the at least one water-swellable tubular collar has an interior surface that is disposed around the exterior surface of the wellbore casing an exterior surface, and further wherein the tubular collar is formed from a material comprising a mixture of sodium bentonite with a swelling inhibitor and a plurality of fibers dispersed in the sodium bentonite, the material having a water content of no greater than about 10 wt. %; and (b) exposing the water-swellable tubular collar to an aqueous environment in the wellbore, whereby the water-swellable tubular collar swells to an extent sufficient to seal the annulus between the wellbore casing and the wall of the wellbore.

16. The method of claim 15, wherein the thickness of the water-swellable tubular collar at the time of insertion into the wellbore, as measured from the interior surface of the collar to the exterior surface of the collar, is at least ⅓ the thickness of the annulus between the wellbore casing and the wall of the wellbore.

17. The method of claim 16, wherein the material comprising the mixture of sodium bentonite, a swelling inhibitor and a plurality of fibers dispersed in the sodium bentonite is characterized in that it swells to 100% of its initial volume upon immersion in water within a time period in the range from about 15 hours to about 20 hours.

18. The method of claim 16, wherein the exterior surface of the water-swellable tubular collar defines a plurality of longitudinal channels disposed around the circumference of the tubular collar, the channels running substantially parallel with one another and with the longitudinal axis of the wellbore casing.

19. The method of claim 15, wherein the wellbore is an oilfield wellbore.

20. The method of claim 15, wherein the wellbore is a geothermal wellbore.

21. The method of claim 15, wherein the wellbore is a mineral leaching wellbore.

22. The method of claim 15, wherein the swelling inhibitor is selected from the group consisting of carboxy methyl cellulose, inorganic phosphates, polyanionic cellulose and methacrylates.

* * * * *

UNITED STATES PATENT AND TRADEMARK OFFICE

CERTIFICATE OF CORRECTION

PATENT NO. : 9,080,419 B2
APPLICATION NO. : 13/542390
DATED : July 14, 2015
INVENTOR(S) : Craig H. Benson et al.

It is certified that error appears in the above-identified patent and that said Letters Patent is hereby corrected as shown below:

ON THE TITLE PAGE

Item (76) Inventors:

Please change the name of the inventor "Ivan Kornienko" to --Ivan Korniyenko--

Signed and Sealed this
Ninth Day of August, 2016

Michelle K. Lee

Michelle K. Lee
*Director of the United States Patent and Trademark Office*